US008847118B2

(12) United States Patent
Sakurai et al.

(10) Patent No.: US 8,847,118 B2
(45) Date of Patent: Sep. 30, 2014

(54) ENERGIZATION CONTROL APPARATUS FOR GLOW PLUG

(75) Inventors: Takayuki Sakurai, Komaki (JP); Takayuki Ohtani, Iwakura (JP)

(73) Assignee: NGK Spark Plug Co., Ltd., Aichi (JP)

( * ) Notice: Subject to any disclaimer, the term of this patent is extended or adjusted under 35 U.S.C. 154(b) by 781 days.

(21) Appl. No.: 13/157,839

(22) Filed: Jun. 10, 2011

(65) Prior Publication Data

US 2011/0303650 A1 Dec. 15, 2011

(30) Foreign Application Priority Data

Jun. 11, 2010 (JP) ..... 2010-133772

(51) Int. Cl.
*F23Q 7/00* (2006.01)
*F23Q 13/00* (2006.01)
*F02P 19/02* (2006.01)

(52) U.S. Cl.
CPC ..... *F02P 19/025* (2013.01); *F02P 19/027* (2013.01)
USPC ..... 219/263; 219/262; 219/268

(58) Field of Classification Search
CPC ..... F02D 41/2432; F02D 41/2464; F02P 19/025; F02P 19/027
USPC ..... 219/260, 262, 263, 264, 268, 494, 497, 219/504
See application file for complete search history.

(56) References Cited

U.S. PATENT DOCUMENTS

| | | | | |
|---|---|---|---|---|
| 7,234,430 | B2 * | 6/2007 | Toedter et al. | 123/179.6 |
| 2009/0200286 | A1 * | 8/2009 | Reissner | 219/264 |
| 2010/0161150 | A1 * | 6/2010 | Sakurai et al. | 700/296 |

FOREIGN PATENT DOCUMENTS

JP 2005-240707 A 9/2005

* cited by examiner

*Primary Examiner* — Dana Ross
*Assistant Examiner* — Lindsey C Teaters
(74) *Attorney, Agent, or Firm* — Sughrue Mion, PLLC

(57) ABSTRACT

An energization control apparatus for a glow plug (21) includes temperature maintaining energization means (34), and intermediate temperature raising means 35 for resuming energization of the glow plug 1 during operation of an engine EN after energization by the temperature maintaining energization means (34). The intermediate temperature raising means (35) includes resistance acquisition means (32); difference calculation means (36) for calculating a difference between the resistance of the glow plug (1) and a target resistance; intermediate value setting means (37); and intermediate value update means (38) for gradually increasing an intermediate target resistance such that the intermediate target resistance finally coincides with the target resistance. The voltage applied to the glow plug (1) is controlled such that the resistance of the glow plug (1) coincides with the intermediate target resistance.

6 Claims, 11 Drawing Sheets

RTRE: RAPID TEMPERATURE RAISING ENERGIZATION

TME: TEMPERATURE MAINTAINING ENERGIZATION

ITR: INTERMEDIATE TEMPERATURE RAISING

ENERGIZATION CONTROL APPARATUS FOR GLOW PLUG

BACKGROUND OF THE INVENTION

1. Field of the Invention

The present invention relates to an energization control apparatus for a glow plug used, for example, for pre-heating a diesel engine.

2. Description of the Related Art

Conventionally, a glow plug which generates heat upon supply of electric current is used to assist startup of an engine of an automobile or the like, or to stably operate the engine. A glow plug is composed of a heating resistor (a heating coil, a ceramic heater, or the like); a control coil and a center rod, which serve as a path for supplying electric power to the heating resistor; a metallic shell; etc.

Heat generation of such a glow plug is controlled by an energization control apparatus. For example, when an engine key is turned on, a large amount of electric power is supplied to the glow plug within a short period of time so as to raise the temperature of the glow plug to a temperature sufficient for starting an engine. In general, such energization for rapidly raising the temperature of the glow plug is called a "pre-glow" or a "pre-glow step." Furthermore, after the glow plug has reached the above-mentioned temperature and the engine has started, for a predetermined period of time, electric power is supplied to the glow plug in order to maintain the temperature of the glow plug at a predetermined temperature. In general, such energization for maintaining the temperature of the glow plug is called "after glow" or an "after glow step."

In recent years, in order to prevent malfunctions caused by a drop in temperature within a combustion chamber following the after glow, such as generation of black smoke at a time when the engine is rapidly brought into a high speed or high output state when the combustion chamber is cold, a technique of re-energizing the glow plug has been proposed to cause the glow plug to again generate heat (perform an intermediate temperature raising) during a period after completion of the after glow while the engine is operating (see, for example, Patent Document 1). This technique is described in detail. First, a first intermediate temperature raising means calculates a duty ratio on the basis of a target resistance corresponding to a target temperature of a glow plug, and controls, by means of PWM (pulse width modulation) control, the supply of electric current to the glow plug in accordance with the duty ratio. Subsequently, a second intermediate temperature raising means calculates the duty ratio on the basis of a voltage applied from a battery to the glow plug, and then controls, by means of PWM control, the energization of the glow plug in accordance with the duty ratio. By providing the first intermediate temperature raising means and the second intermediate temperature raising means, the temperature of the glow plug can be raised rapidly at the initial stage of the intermediate temperature raising operation. Also, in a state in which the temperature of the glow plug approaches a target temperature, the temperature of the glow plug can be stably maintained at the target temperature.

[Patent Document 1] Japanese Patent Application Laid-Open (kokai) No. 2005-240707

3. Problems to be Solved by the Invention

Since the duty ratio is calculated on the basis of the voltage applied from a battery to a glow plug, maintaining the glow plug at a constant temperature is difficult in the case where the glow plug is thermally influenced from the outside, such as the case where the heating resistor of the glow plug is cooled because of a disturbance caused by a change in engine speed, load (throttle opening), water temperature, etc. In order to maintain the temperature of the glow plug constant, it is necessary to obtain information regarding the engine speed, load, etc., from, for example, an ECU, and control the effective voltage applied to the glow plug on the basis of the information thus obtained. However, if a to-be-applied effective voltage is calculated in accordance with changes in various parameters, such as engine speed, load, and water temperature, the processing load on the ECU may increase. In order to reduce such a processing load, the energization control apparatus may be configured to use a previously prepared map which can univocally determine the to-be-applied effective voltage from the above-mentioned various parameters and a target temperature, and which can perform energization control on the basis of the map. However, such a map must be prepared by changing the above-mentioned various parameters in various ways such that the to-be-applied effective voltage can be determined univocally in all situations. Therefore, it causes an increase in troublesome preparation for creating the map, and the period of time required to complete the map becomes longer.

In over to overcome such drawbacks, energization control for a glow plug may be performed through control based on the resistance of the glow plug alone. However, in such a case, the following problem may arise. The value measured as the resistance of the glow plug is not the resistance of the heating resistor, but the sum of the resistance of the heating resistor, the resistances of a control coil and a center rod, the resistance of a power supply harness connected to the glow plug, and the resistance of a metallic shell. Furthermore, as the target resistance, the resistance of the glow plug is set at the time when the temperature of the glow plug becomes saturated at the target temperature (that is, the control coil, the center rod, etc., also become saturated). Accordingly, in the case where resistance control is performed such that the resistance of the glow plug coincides with the target resistance, the following problem occurs. In an initial stage of the intermediate temperature raising operation (in a stage in which the temperatures of the control coil, the center rod, etc., have not yet become saturated), the ratio of the resistance of the heating resistor to the resistance of the glow plug is relatively large. Therefore, electric power, which is normally used to raise the temperatures of the control coil, etc., is used to cause the heating resistor to generate heat, whereby the temperature of the heating resistor is raised rapidly. Therefore, overshoot (excessive temperature rising) of the glow plug (the heating resistor) may arise. Furthermore, since the temperature of the heating resistor is gradually transmitted to the control coil, the center rod, etc., after that time, the ratio of the resistance of the heating resistor to the resistance of the glow plug decreases. Therefore, if energization control is performed with the target resistance maintained constant, the temperature of the heating resistor becomes lower than the target temperature. That is, the temperature of the glow plug, which has once increased excessively, decreases at this time. Therefore, the temperature of the glow plug may vary greatly around the target temperature, and a relatively long period of time may be required for allowing the temperature of the glow plug to stabilize the target temperature.

SUMMARY OF THE INVENTION

The present invention has been achieved in view of the above circumstances, and an object thereof is to provide an energization control apparatus for a glow plug which controls the supply of electric current to the glow plug in accordance with a resistance control scheme so that the resistance of the glow plug coincides with a predetermined target resistance, and which apparatus can quickly raise the temperature of the glow plug during intermediate temperature raising, more reliably prevent the occurrence of temperature variation or overshoot of the glow plug, and enable the glow plug to stably generate heat at a target temperature within a short period of time.

The above object of the invention has been achieved by providing an energization apparatus configured as follows. As needed, the actions and effects specific to individual configurations will additionally be described.

Configuration 1. An energization control apparatus for a glow plug which generates heat upon supply of electric current thereto and having a resistance which changes in accordance with its own temperature, the energization control apparatus controlling a voltage applied to the glow plug in accordance with a resistance control scheme so that the resistance of the glow plug coincides with a predetermined target resistance, the apparatus comprising:

temperature maintaining energization means for energizing the glow plug for heat generation during operation of an internal combustion engine to which the glow plug is attached; and intermediate temperature raising means for resuming energization of the glow plug during operation of the internal combustion engine, after energization by the temperature maintaining energization means, wherein the intermediate temperature raising means includes:

resistance acquisition means for acquiring the resistance of the glow plug;

difference calculation means for calculating a difference between the resistance of the glow plug acquired by the resistance acquisition means and the target resistance;

intermediate value setting means for setting an intermediate target resistance by subtracting an offset value corresponding to the difference between the resistance of the glow plug and the target resistance; and intermediate value update means for (gradually) increasing the intermediate target resistance with elapse of time for energization of the glow plug such that the intermediate target resistance finally coincides with the target resistance, wherein the voltage applied to the glow plug is controlled such that the resistance of the glow plug coincides with the intermediate target resistance.

Notably, "during operation of the internal combustion engine" refers to a state in which an engine key (ignition key) is on, and includes a state in which the internal combustion engine is not started. That is, a case may exist where energization of the glow plug is performed by the temperature maintaining energization means, etc., in a state in which the engine key has been turned on and the internal combustion engine has been started. A case may also exist where energization of the glow plug is performed by the temperature maintaining energization means, etc., in a state in which the engine key has been turned on, but the internal combustion engine has not yet been started.

The "resistance of the glow plug" does not refer to the resistance of the heating resistor, but refers to the sum of the resistance of the heating resistor and the resistances of components (e.g., a harness, center rod, a control coil, etc.) which are present in an electrical path through which electric current is supplied to the heating resistor. In addition, the "target resistance" refers to a resistance of the glow plug at the time when the temperature of the glow plug becomes saturated at a target temperature (that is, when the temperatures of the control coil, the center rod, etc., also become saturated).

According to the above-described configuration 1, during the intermediate temperature raising, energization control of the glow plug is performed in accordance with a resistance control scheme. Therefore, the temperature of the glow plug can be raised relatively rapidly, without causing problems, such as an increase in the above-mentioned processing load, which would otherwise occur in the case where the energization control is performed on the basis of the voltage applied from a battery to the glow plug.

In the case where energization of a glow plug is controlled in accordance with the resistance control scheme, various problems may arise, such as temperature variation and/or overshoot of the glow plug, and the glow plug may require a long time to stabilize at a target temperature. In contrast, according to the above-described configuration 1, a value obtained by subtracting, from the target resistance, an offset value corresponding to the difference between the resistance of the glow plug and the target resistance is set as an intermediate target resistance. The energization of the glow plug is then controlled such that the resistance of the glow plug coincides with the intermediate target resistance, which is gradually increased with elapse of the energization time such that it finally coincides with the target resistance. That is, at the beginning of the intermediate temperature raising (in a stage in which an excessive rise in temperature of the glow plug may occur), the energization control of the glow plug is performed, while a resistance lower than the original target resistance is used as an intermediate target resistance. Thus, the temperature of the glow plug is raised rapidly, while the occurrence of an excessive rise in temperature is prevented more reliably. In a stage in which a temperature drop of the glow plug may occur, by means of gradually increasing the intermediate target resistance, the glow plug is caused to finally reach the target temperature, without causing a temperature drop of the glow plug. By performing energization control on the basis of the intermediate target resistance lower than the target resistance and by gradually increasing the intermediate target resistance as described above, it becomes possible to prevent overshoot of the glow plug more reliably, and to effectively suppress temperature variation of the glow plug around the target temperature. As a result, the glow plug can be caused to more stably generate heat at the target temperature within a short period of time.

Notably, in general, heating temperature and heat resistant temperature may vary among glow plugs due to production tolerances of components. In consideration of this variation, the target temperature of each glow plug is set to a very low temperature equal to or less than the heat resistant temperature thereof (e.g., such that the difference between the target temperature and the heat resistant temperature is 75° C. or more). In such a case, even when the temperature of the glow plug somewhat exceeds the target temperature, the temperature of the glow plug does not exceed the heat resistant temperature of the glow plug. In contrast, according to the above-described configuration 1, the intermediate target resistance is set in consideration of the target temperature (the target resistance), and the intermediate target resistance is updated to gradually increase. Therefore, it is possible to suppress a temperature variation of the glow plug around the target temperature, without excessively lowering the temperature raising speed. Thus, the target temperature of the glow plug can be set closer to the heat resistant temperature of the glow plug (e.g., the target temperature can be set such that the difference between the target temperature and the heat resistant temperature becomes 50° C. or less). Therefore, it becomes possible to set the target temperature to be very close to the heat resistant temperature of the glow plug. Accordingly, further reduction of emissions becomes possible by means of setting a high target temperature (e.g., 1200° C. or higher), without replacing the glow plug itself with a glow plug which is higher in heat resistant temperature than the former one.

Configuration 2. The energization control apparatus for a glow plug according to the above-mentioned configuration 1, wherein the greater the difference between the resistance of the glow plug and the target resistance, the greater the value to which the offset value is set.

According to the above-described configuration 2, the greater the difference between the resistance of the glow plug and the target resistance, the greater the value to which the offset value is set. That is, in the case where a temperature drop of the glow plug in relation to the target temperature is relatively large (the case where, due to relatively low resistance of the glow plug, a large amount of electric power is likely to be applied to the glow plug at a time, and overshoot of the glow plug is likely to occur), a sufficiently small value is set as the intermediate target resistance. Therefore, it becomes possible to prevent overshoot of the glow plug more reliably, and to cause the glow plug to more stably generate heat at the target temperature within a short period of time.

Configuration 3. The energization control apparatus for a glow plug according to the above-mentioned configuration 1 or 2, wherein when the difference between the resistance of the glow plug and the target resistance is equal to or greater than a previously set maximum difference, the offset value is set to a predetermined maximum offset value.

When the difference between the resistance of the glow plug and the target resistance is large as in the case of the above-described configuration 2, overshoot of the glow plug is likely to occur. However, in the case where the difference between the resistance of the glow plug and the target resistance is very large; that is, in the case where the temperature of the glow plug is far below the target temperature, overshoot of the glow plug is unlikely to occur even when a large voltage is applied to the glow plug.

In view of the above, according to the above-described configuration 3, when the difference between the resistance of the glow plug and the target resistance is equal to or greater than a predetermined maximum difference, the offset value is set to a predetermined maximum offset value. That is, in the case where the difference between the temperature of the glow plug and the target temperature is sufficiently large and overshoot of the glow plug is unlikely to occur even when a relatively large voltage is applied thereto, the intermediate target resistance is not decreased to an excessively low value, and a constant value is set as the intermediate target resistance. Therefore, the temperature of the glow plug can be raised more rapidly, and the time required for the temperature raising can be further shortened.

Configuration 4. The energization control apparatus for a glow plug according to any one of the above-mentioned configurations 1 to 3, wherein as the difference between the intermediate target resistance and the target resistance decreases, the amount by which the intermediate target resistance is increased per unit time by the intermediate value update means is decreased.

Notably, the "amount by which the intermediate target resistance is increased per unit time by the intermediate value update means" may be decreased continuously or stepwise as the difference between the intermediate target resistance and the target resistance decreases.

According to the above-described configuration 4, the amount of increase per unit time of the intermediate target resistance is decreased as the difference between the intermediate target resistance and the target resistance decreases; that is, as the temperature of the glow plug approaches the target temperature. Accordingly, it is possible to cause the glow plug to generate heat at the target temperature with even greater stably, after having reached the target temperature, while suppressing excessive temperature rising of the glow plug.

The intermediate target resistance is not necessarily updated at constant intervals. For example, the intervals may be shortened continuously or stepwise as the difference decreases. In this case, as the resistance of the glow plug approaches the target resistance (in other words, as the possibility of the occurrence of overshoot increases), the increase amount of the intermediate target resistance is set to a finer degree, whereby overshoot can be prevented with even greater reliability.

Configuration 5. The energization control apparatus for a glow plug according to any of the above-mentioned configurations 1 to 4, wherein the target resistance is updated on the basis of information representing a change in a disturbance which causes a temperature change of the glow plug.

In a combustion chamber, the heating resistor of the glow plug may be cooled by the influence of disturbances such as swirl, fuel injection, and the like. Therefore, in order to cause the glow plug to reach the target temperature more reliably, the electric power supplied to the glow plug is preferably increased by an amount corresponding to the extent of the respective disturbances.

In this regard, according to the above-described configuration 5, the target resistance is updated on the basis of information representing a change in a disturbance which causes a temperature change of the glow plug (for example, the target resistance is increased so as to compensate for cooling of the heating resistor attributable to the influences of swirl, etc.). Accordingly, the target resistance can be set more properly, and the glow plug can be caused to reach the target temperature more reliably and accurately. Furthermore, the glow plug can generate heat at the target temperature with even greater stability.

Notably, the "information representing a change in a disturbance which causes a temperature change" refers to information representing change in at least one of various disturbances which impart changes to a combustion chamber in which the glow plug is disposed, such as open timings of intake and exhaust valves, which may change the strength of the above-mentioned swirl, flow velocity of air (detected by an air flow sensor or the like), and fuel injection amount.

Configuration 6. The energization control apparatus for a glow plug according to any of the above-mentioned configurations 1 to 5, further comprising environmental temperature acquisition means for acquiring information representing a temperature of an environment in which the glow plug is used, wherein the target resistance is set in consideration of information representing the environmental temperature; and the target resistance is fixed until a previously set, predetermined period elapses after resumption of energization of the glow plug, excepting that the target resistance is changed depending on the information representing the environmental temperature.

Notably, the "predetermined period" is a period in an initial stage of the intermediate temperature raising in which overshoot of the glow plug is likely to occur. Although such a period may change in accordance with the characteristics of the glow plug or the internal combustion engine, the period may be set to be approximately equal to a time required for rapid temperature raising (pre glow) of the glow plug in a state in which the internal combustion engine is stopped.

According to the above-described configuration 6, when the target resistance is set, environmental information representing, for example, changes in water temperature and oil temperature, is taken into consideration. Therefore, the target resistance can be set more suitably, and the temperature of the glow plug can be caused to reach the target temperature with even greater reliability and accuracy. Also, the temperature of the glow plug can be maintained at the target temperature in a more stable state.

Meanwhile, the target resistance is substantially fixed until the above-mentioned predetermined period elapses immediately after resumption of the energization of the glow plug, although the target resistance is changed on the basis of the information representing the environmental temperature. That is, in the above-mentioned predetermined period, correction of the target resistance for disturbances as described in the above-described configuration 5 is not performed. Accordingly, in the initial stage of the intermediate temperature raising (when the resistance of the glow plug is relatively low), the target resistance (accordingly, the intermediate target resistance) is decreased to some extent, whereby overshoot of the glow plug can be prevented with greater reliability.

BRIEF DESCRIPTION OF THE DRAWINGS

FIG. 6 is a flowchart showing energization control performed when an engine key is turned on.

DESCRIPTION OF REFERENCE NUMERALS

Figure 1A:
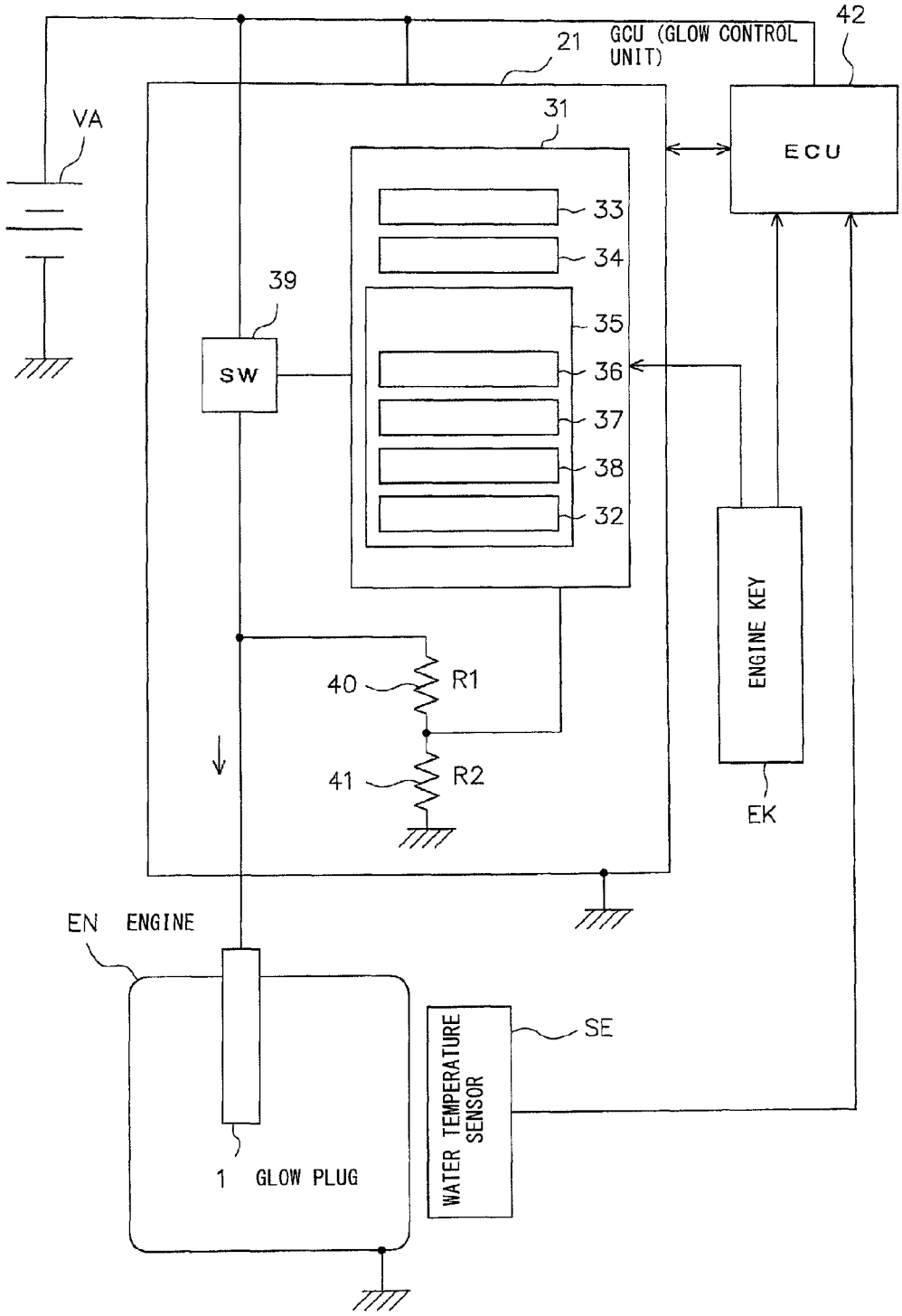
FIGS. 1A and 1B are block diagrams showing the configuration of a system for controlling the supply of electric current to a glow plug by a glow control unit (GCU).

Reference numerals used to identify various features in the drawings include:

1: glow plug
21: GCU (glow control unit)
32: resistance acquisition means
34: temperature maintaining energization means
35: intermediate temperature raising means
36: difference calculation means
37: intermediate value setting mean
38: intermediate value update mean
EN: engine
SE: water temperature sensor (environmental temperature acquisition means)

DETAILED DESCRIPTION OF THE PREFERRED EMBODIMENTS

An embodiment of the invention will now be described with reference to the drawings. However, the present invention should not be construed as being limited thereto.

A glow control unit (GCU) 21, which serves as an energization control apparatus, is used to control energization of a glow plug 1, to thereby assist startup of a diesel engine (hereinafter referred to as the "engine") EN of an automobile and improve operation stability of the engine EN.

Before describing the GCU 21, the structure of the glow plug 1, which is controlled by the GCU 21, will first be described briefly.

Figure 12A:
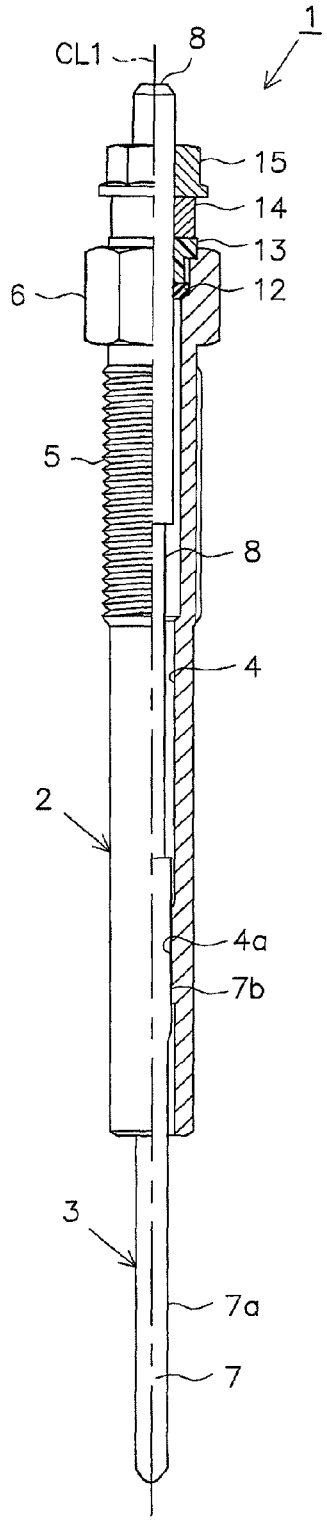
FIG. 12A is a partially cutaway front view of a glow plug.
Figure 12B:
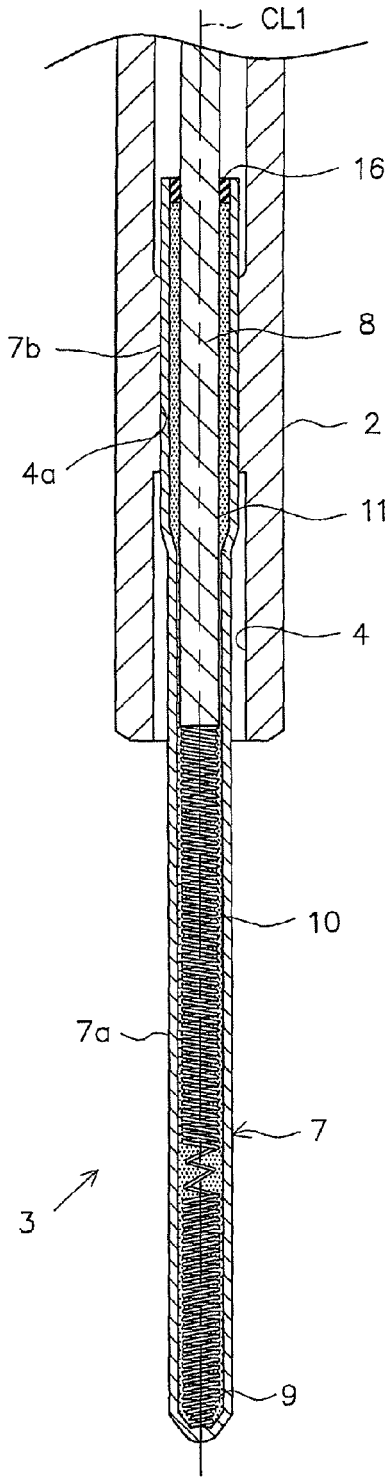
FIG. 12B is a partial enlarged cross-sectional view of a front end portion of the glow plug.

As shown in FIGS. 12A and 12B, the glow plug 1 includes a tubular metallic shell 2, and a sheath heater 3 attached to the metallic shell 2.

The metallic shell 2 has an axial hole 4 extending through the metallic shell 2 in the direction of an axis CL1. The metallic shell 2 also has, on its outer circumferential surface, a screw portion 5 for attachment to the engine EN, and a tool engagement portion 6, which has a hexagonal cross section and with which a tool such as a torque wrench, is engaged.

The sheath heater 3 includes a tube 7 and a center rod 8 united together in the direction of the axis CL1.

The tube 7 is a cylindrical tube mainly formed of iron (Fe) or nickel (Ni) and having a closed front end. The rear end of the tube 7 is sealed by an annular rubber member 16 disposed between the rear end of the tube 7 and the center rod 8. A heating coil 9 and a control coil 10 are disposed inside the tube 7 together with insulating powder 11, such as magnesium oxide (MgO). The heating coil 9 is connected to the front end of the tube 7, and the control coil 10 is connected in series to the rear end of the heating coil 9.

The heating coil 9 is formed, for example, from a heating resistance wire made of a Fe-chromium (Cr)-aluminum (Al) alloy. Meanwhile, the control coil 10 is formed, for example, from a heating resistance wire containing Ni as a main component. Notably, of the heating coil 9 and the control coil 10, at least the heating coil 9 changes in resistance with its own temperature such that the resistance has a positive correlation with temperature.

Through swaging or the like, a small diameter portion 7*a* for accommodating the heating coil 9, etc., is formed at a front end portion of the tube 7, and a large diameter portion 7*b*, which is larger in diameter than the small diameter portion 7*a*, is formed rearward of the small diameter portion 7*a*. The large diameter portion 7*b* is press-fitted into a small diameter portion 4*a* of the axial hole 4 of the metallic shell 2, whereby the tube 7 is held in a state in which the tube 7 projects from the front end of the metallic shell 2.

The center rod 8 extends through the axial hole 4 of the metallic shell 2. The front end of the center rod 8 is inserted into the tube 7, and is electrically connected to the rear end of the control coil 10. The rear end of the center rod 8 projects from the rear end of the metallic shell 2. At a rear end portion of the metallic shell 2, an O-ring 12 formed of rubber or the like, an insulating bushing 13 formed of resin or the like, a holding ring 14 for preventing the insulating bushing 13 from coming off, and a nut 15 for connecting an electric current supply cable are fitted onto the center rod 8 in this order from the front end side.

Next, the glow control unit (GCU) 21, which is the feature of the present invention, will be described.

Figure 1B:
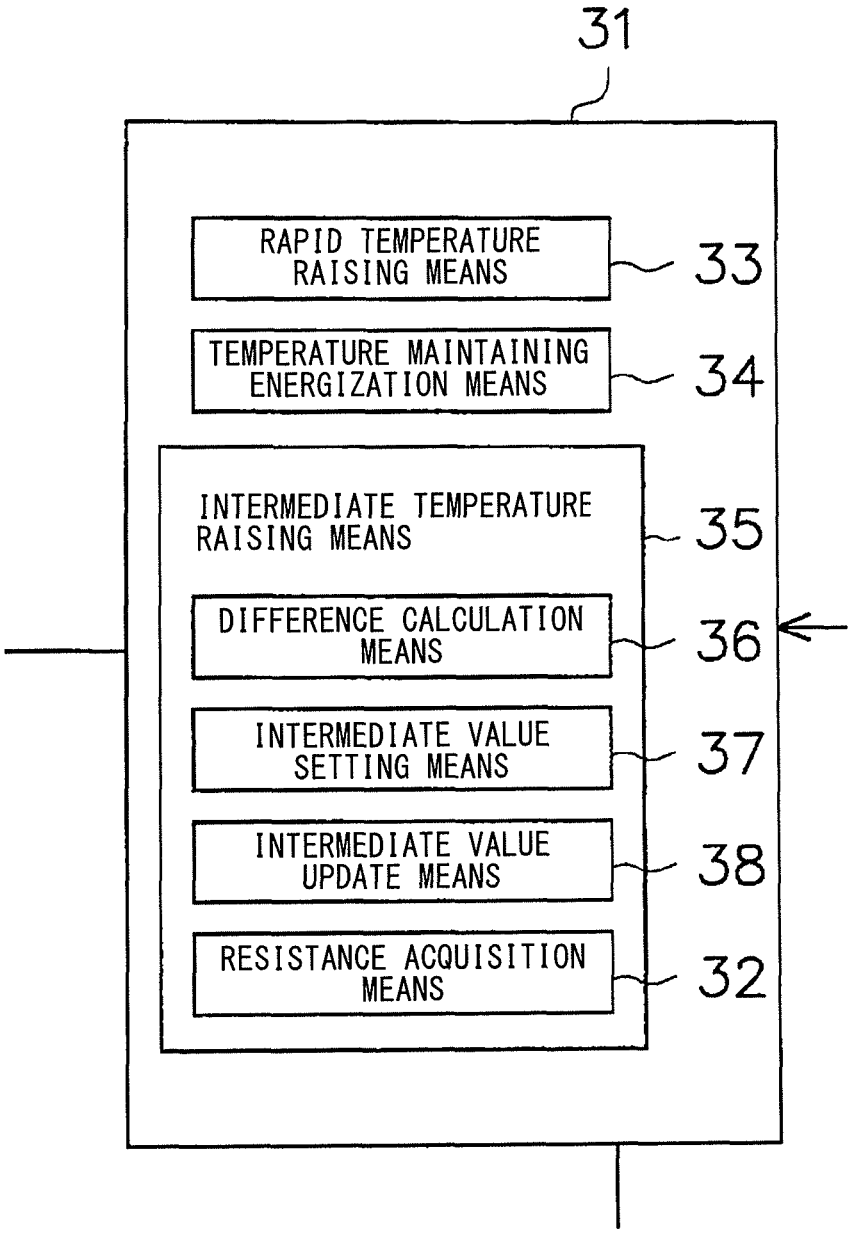

FIGS. 1A and 1B are block diagrams showing the configuration of a system for controlling the supply of electric current to the glow plug 1 by the GCU 21. Notably, in FIG. 1A, the glow plug 1 is shown as being single in number. However, in actuality, the engine EN has a plurality of cylinders. Therefore, the glow plug 1 and a switch 39 described below are provided for each cylinder. Furthermore, although the GCU 21 independently performs energization control for the individual glow plugs 1, the control method is the same among the glow plugs 1. Accordingly, in the following, the energization control which the GCU 21 performs for a certain one glow plug 1 will be described.

The GCU 21 operates while using electric power supplied from a battery VA, and includes a microcomputer 31 composed of a CPU, ROM, RAM, etc.

The microcomputer 31 executes various programs, such as an energization control program. A signal representing whether an engine key EK is on or off is input to the microcomputer 31. At the time of startup of the CPU, the CPU performs initialization (so-called initialization processing, including clearing of internal registers and the RAM, and setting of respective initial values to various flags and counters).

In addition, the switch 39 is provided in the GCU 21. The GCU 21 controls the supply of electric current to the glow plug 1 trough PWM (pulse width modulation) control, and the switch 39 starts and stops the supply of electric current to the glow plug 1 in accordance with instructions from the microcomputer 31.

Moreover, the microcomputer 31 includes resistance acquisition means 32 for measuring the resistance of the glow plug 1 (notably, the "resistance of the glow plug 1" is the sum of the resistance of the heating coil 9, the resistances of the control coil 10, the center rod 8, a power supply harness connected to the glow plug 1, and the resistance of the metallic shell 2). In the present embodiment, the resistance of the glow plug 1 is acquired as follows. That is, the switch 39 is configured to operate an FET (field effect transistor) having a current detection function via an NPN-type transistor or the like. Also, the microcomputer 31 is connected to the power supply terminal of the glow plug 1 via voltage division resistors 40 and 41. Accordingly, the microcomputer 31 can acquire current flowing from the FET to the glow plug 1 and voltage produced through voltage division of the voltage applied to the glow plug 1. The resistance acquisition means 32 can calculate the voltage applied to the glow plug 1 on the basis of the voltage input to the microcomputer 31, and obtain the resistance of the glow plug 1 from the applied voltage and the current flowing through the glow plug 1.

Notably, a relatively inexpensive FET having no current detection function may be used as the switch 39. In this case, a shunt resistor is provided, for example, between the switch 39 and the glow plug 1, and current flowing through the shunt resistor is measured so as to measure the resistance of the glow plug 1. Alternatively, a resistor for current detection may be provided in parallel to the switch 39. In this case, when the supply of electric current to the glow plug 1 is stopped, a predetermined current is supplied to the glow plug 1 via the resistor, and the resistance of the glow plug 1 is calculated on the basis of a voltage obtained through voltage division.

In addition, the GCU 21 is connected to an electronic control unit (ECU) 42 of the automobile via a predetermined communication means (e.g., CAN (Controller Area Network), etc.). The ECU 42 receives a measurement value from a water temperature sensor SE, which measures the temperature of cooling water of the engine EN. The GCU 21 acquires the temperature of the cooling water (water temperature information) from the ECU 42 as information regarding the environmental temperature. Notably, the GCU 21 may be configured to acquire the water temperature information directly from the water temperature sensor SE, without acquiring the water temperature information from the ECU 42. Notably, the water temperature sensor SE corresponds to the "environmental temperature acquisition means" in the present invention.

Moreover, the GCU 21 has a function of detecting exchange of the glow plug 1. Notably, exchange of the glow plug 1 is detected as follows. That is, when the engine EN is stopped, the GCU 21 supplies electric current to the glow plug 1 at short intervals (e.g., 25 ms), and periodically acquires the resistance of the glow plug 1 from the voltage applied to the glow plug 1 at that time and the current flowing through the glow plug 1. The GCU 21 determines, through comparison, whether or not the acquired resistance is greater than a predetermined threshold value (exchange determination value). When the glow plug 1 is removed from the engine EN, the glow plug 1 is not present in the circuit of the GCU 21. Therefore, no current flows through the glow plug 1, and a very large resistance is acquired. Therefore, when the resistance of the glow plug 1 is greater than the exchange determination value, the GCU 21 determines that the glow plug 1 has been removed; that is, the glow plug 1 has been exchanged, and sets an exchange flag. Meanwhile, when the resistance of the glow plug 1 is equal to or less than the exchange determination value, the GCU 21 determines that the glow plug 1 has not been exchanged. Notably, the method for detecting exchange of the glow plug 1 is not limited to the above-described method, and other methods may be used. For example, a method can be employed in which a user inputs a signal indicating exchange of the glow plug 1 to the GCU 21 via predetermined input means.

Furthermore, in the GCU 21 configured as described above, in order to control the supply of electric current to the glow plug 1, a pre-correction target resistance $R_0$ of the glow plug 1 is obtained through calibration (correction/adjustment) performed on the correlation between the temperature and resistance of the glow plug 1. Notably, the "pre-correction target resistance $R_0$" refers to a resistance based on which a resistance (target resistance $R_{TAR}$) of the glow plug 1 corresponding to a target temperature of the glow plug 1 is calculated in energization control for the glow plug 1, as described below.

Calibration of the glow plug 1 is performed when exchange of the glow plug 1 is detected or when the pre-correction target resistance $R_0$ is cleared. In order to avoid influences of disturbances, such as swirl produced in a combustion chamber and cooling by fuel injection, calibration is performed when the engine EN is not operated. In calibration, since the glow plug 1 is caused to reach a temperature approximately equal to a temperature at the time of startup of the engine EN, the glow plug 1 consumes a large amount of electric power. Therefore, calibration is performed when the engine EN is operated and then stopped; i.e., when the battery VA has been charged.

Calibration is performed as follows. That is, the resistances of individual glow plugs 1 vary due to various factors, and, due to the influence of the variation, even glow plugs of the same model number differ from one another in relation between temperature and resistance. However, the relation between the cumulative amount of supplied electric power and the amount of generated heat depends on the material of the heating resistor (the heating coil 9) of each glow plug 1, and exhibits a relatively small variation among the glow plugs. Therefore, electric current is supplied to a glow plug (heat resistor) which serves as a reference such that its temperature rise becomes saturated at a temperature which is to be used as a control target (target temperature), and the cumulative amount of electric power supplied at that time (cumulative electric energy) is obtained. Then, at the time of calibration, this cumulative electric power is supplied to each individual glow plug 1 to be calibrated, and the resistance of the glow plug 1 at that time (when the above-mentioned cumulative electric power is supplied) is obtained as a pre-correction target resistance $R_0$ for the individual glow plug 1. If resistance control is performed for each glow plug 1 on the basis of the corresponding pre-correction target resistance $R_0$, correction can be performed such that variation among the plurality of glow plugs 1 is eliminated. Notably, in the present embodiment, the resistance obtained in the above-described manner is used as the pre-correction target resistance $R_0$. However, the method for calibration is not limited to the above-described method.

Also, the microcomputer 31 has a function of detecting anomalies, such as breakage of wiring or the like and over current. When the microcomputer 31 detects an anomaly, such as breakage of wiring or the like, or an excessively large current flowing through the switch 39, in order to prevent breakage of components (e.g., the FET of the switch 39), the microcomputer 31 controls the switch 39 so as to stop the supply of electric current to the glow plug 1. Notably, the function of detecting anomalies such as wire breakage, etc., may be realized by the circuit configuration of the GCU 21.

Moreover, the microcomputer 31 includes rapid temperature raising means 33, temperature maintaining energization means 34, and intermediate temperature raising means 35.

The rapid temperature raising means 33 supplies a large amount of electric power to the glow plug 1 when the engine key EK is turned on, to thereby cause the glow plug 1 to quickly reach a predetermined target temperature (in the present embodiment, 1200° C.).

In this rapid temperature raising energization, a curve representing the relation between electric power supplied to the glow plug 1 and elapsed time is rendered coincident with a previously prepared reference curve, whereby the glow plug 1 is caused to reach the target temperature rapidly (within about 2.0 sec) irrespective of the characteristics of the glow plug 1. Specifically, by making use of a table or relational expression which shows the previously determined reference curve, an amount of electric power to be supplied at each point in time is obtained in accordance with the time that has elapsed from the start of energization. A voltage to be applied to the glow plug 1 is obtained from the relation between the current flowing through the glow plug 1 and the amount of electric power to be supplied at each point, and the voltage applied to the glow plug 1 is controlled through PWM control. As a result, the supply of electric power is performed such that the curve representing the relation between the supplied electric power and elapsed time coincides with the reference curve, whereby the glow plug 1 generates heat in accordance with the cumulative amount of electric power supplied up to each point in time during the temperature raising process. Accordingly, upon completion of supply of electric power along the reference curve, the glow plug 1 reaches the target temperature within a time determined by the reference curve.

The temperature maintaining energization means 34 performs temperature maintaining energization (also called "after glow") for maintaining the glow plug 1 at the target temperature for a predetermined period of time after the glow plug 1 has reached the target temperature. By carrying out the temperature maintaining energization of the glow plug 1, before startup of the engine EN, a state can be established in which the engine EN can be started at any time. Furthermore, after startup of the engine EN, the warming of gas within a combustion chamber of the engine is accelerated. Therefore, generation of diesel knocking can be prevented, generation of noise and white smoke can be suppressed, and emission of an HC component can be suppressed.

In addition, during the temperature maintaining energization, the supply of electric current to the glow plug 1 is controlled on the basis of the difference between the electrical resistance R of the glow plug 1 and the target resistance $R_{TAR}$. Notably, the "target resistance $R_{TAR}$" is a target resistance obtained by correcting the pre-correction target resistance $R_0$ of the glow plug 1 obtained through calibration in order to remove the influence of disturbances such as change in water temperature, swirl, etc. In the temperature maintaining energization in the present embodiment, a control effective voltage $V_1$ based on the difference $(R_{TAR}-R)$ is set through PI (proportional-integral) control. Subsequently, a duty ratio is calculated from the set control effective voltage $V_1$ and a voltage output from the GCU 21 to the glow plug 1 (controller output voltage), and the supply of electric current to the glow plug 1 is controlled in accordance with the duty ratio. Notably, for calculation of the duty ratio, the supply voltage of the battery VA may be used in place of the output voltage from the GCU 21.

In the present embodiment, the control effective voltage $V_1$ is set on the basis of an expression "$V_1=V_0+K\times\{(R_{TAR}-R)+(T_S/T_I)\times\Sigma(R_{TAR}-R)\}$." Notably, $V_0$ is a reference effective voltage; K is a proportional term coefficient; $T_1$ is an integral term coefficient; and $T_S$ is a sampling time. In the present embodiment, the coefficients K, $T_1$ and the time $T_S$ are set to predetermined values in advance. Also, the reference effective voltage $V_0$ is acquired on the basis of the set target temperature and from an expression (voltage-temperature relational expression) representing the relation between a temperature of the glow plug 1 in a disturbance-free state and an effective voltage to be applied to the glow plug 1 so as to cause the glow plug 1 to reach that temperature. Notably, the voltage-temperature relational expression represents an approximated first-order correlation between the temperature of the glow plug and the reference effective voltage $V_0$, and, in the present embodiment, is prepared in advance.

Notably, after the rapid temperature raising energization, electric power may be supplied to the glow plug 1 before the temperature maintaining energization such that the resistance of the glow plug 1 becomes saturated at the target resistance $R_{TAR}$ after a predetermined period (e.g., 20 sec). With this operation, the temperature of the glow plug 1 can be maintained at the target temperature more stably.

The intermediate temperature raising means 35 performs re-energization of the glow plug 1 during operation of the engine EN to thereby again raise the temperature of the glow plug 1 (perform intermediate temperature raising). In the intermediate temperature raising, as in the case of the above-described temperature maintaining energization, the control effective voltage $V_1$ to be applied to the glow plug 1 is calculated, through PI control, on the basis of the difference $(R-R_{MID})$ between the electrical resistance R of the glow plug 1 and an intermediate target resistance $R_{MID}$ described below. Subsequently, a duty ratio is calculated from the calculated control effective voltage $V_1$ and the above-mentioned controller output voltage, and the supply of electric current to the glow plug 1 is controlled in accordance with the duty ratio. Notably, the intermediate energization is performed after energization by the temperature maintaining energization means 34 has been completed, in the case where reheating by the glow plug 1 becomes necessary or in the case where energization is resumed after recovery from an anomalous state (i.e., an anomalous state in which energization of the glow plug 1 is stopped because of the occurrence of an anomaly).

The intermediate temperature raising means 35 includes difference calculation means 36, intermediate value setting means 37, and intermediate value update means 38.

The difference calculation means 36 calculates the difference $\Delta X$ between the target resistance $R_{TAR}$ and the resistance R of the glow plug 1 acquired by the resistance acquisition means 32. The difference $\Delta X$ indicates the amount by which the temperature of the glow plug 1 is lower than the target temperature.

Notably, as in the case of temperature maintaining energization, the target resistance $R_{TAR}$ is a target resistance obtained by means of correcting the pre-correction target resistance $R_0$ of the glow plug 1 by an amount corresponding to the influence of water temperature change and/or the influence of disturbances such as swirl.

Figure 2:
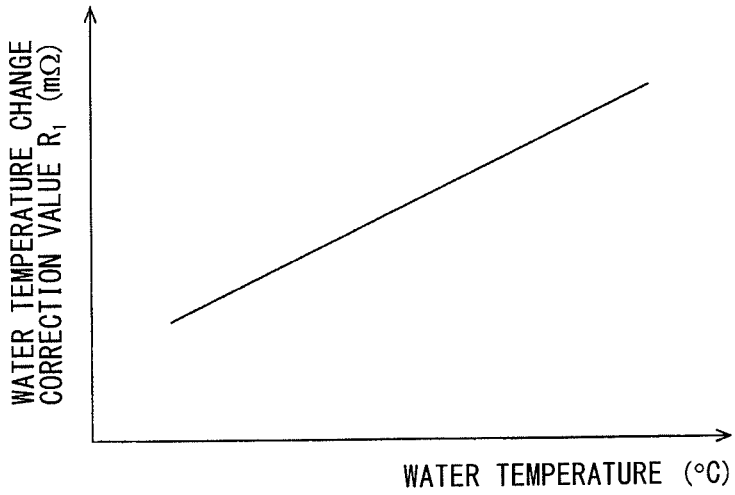
FIG. 2 is a graph showing an example of a water temperature correction expression.

The correction for change in water temperature is performed as follows. That is, on the basis of a previously set correction expression (water temperature correction expression) showing the relation between water temperature and correction value, a correction value $R_1$ for water temperature change is calculated from the difference between water temperature measured by the water temperature sensor SE and water temperature stored at the time of calibration. The obtained correction value $R_1$ for water temperature change is added to the pre-correction target resistance $R_0$, whereby the target resistance $R_{TAR}$ corrected for the influence of water temperature change is obtained. Notably, the water temperature correction expression can be specified for each engine type (in other words, the water temperature correction expression does not change depending on the type of the plug), and represents a first-order correlation between water temperature and correction value for water temperature change as shown in FIG. 2.

In the present embodiment, the correction for disturbances such as swirl is performed as follows. That is, on the basis of a swirl correction expression set in advance, a correction value $R_2$ for swirl is calculated from the difference between the average value of effective voltage applied to the glow plug 1 within a predetermined period of time (average effective voltage) and a standard effective voltage set for each glow plug type (model number) as an effective voltage to be applied so as to cause the glow plug 1 to reach the target temperature. The calculated correction value $R_2$ for swirl is added to the pre-correction target resistance $R_0$, whereby the target resistance $R_{TAR}$ corrected for the influence of disturbances such as swirl is obtained.

Figure 3:
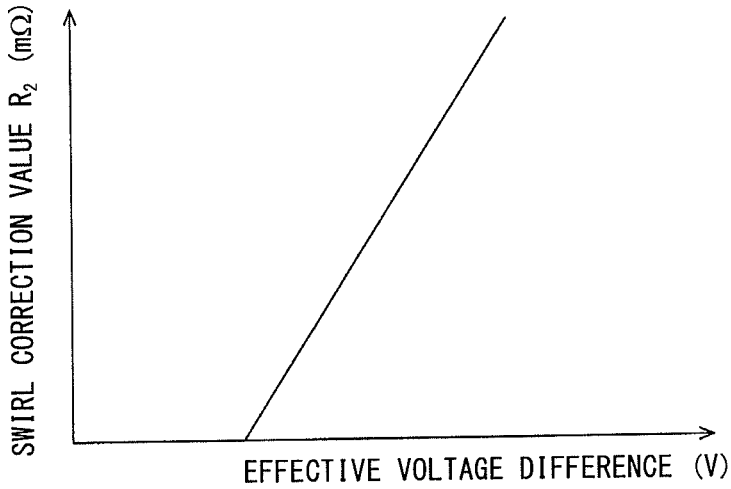
FIG. 3 is a graph showing an example of a swirl correction expression.

Notably, the swirl correction expression is obtained through a bench test in which the engine is solely operated, while engine speed, load, water temperature, etc., are changed in various ways. As shown in FIG. 3, the swirl correction expression represents the relation between the difference (effective voltage difference) obtained by subtracting the standard effective voltage from the average effective voltage, and the correction value $R_2$ for swirl which corresponds to the difference (that is, the difference between the resistance of the glow plug when the engine is operated and the resistance of the glow plug when the engine is not operated). In particular, in the present embodiment, in view of empirically-obtained knowledge that the effective voltage difference and the correction value $R_2$ for swirl have a first-order correlation therebetween, the correction expression is determined as follows. A point at which the correction value $R_2$ for swirl becomes zero when the average effective voltage is equal to the standard effective voltage is used as a reference point, and a linear expression is derived from coordinates of several points which were obtained by means of changing engine speed, load, etc., and which represent the relation between the effective voltage difference and the correction value $R_2$ for swirl. The thus-derived linear expression is used as a correction expression. Notably, this correction expression is commonly used for energization control of a plurality of glow plugs 1. Furthermore, in the present embodiment, a value corresponding to the type of the spark plug 1 is set in advance as the standard effective voltage.

In the present embodiment, before a previously set, predetermined period $T_1$ (e.g., 2.0 sec) elapses after the start of the intermediate temperature raising, the correction for disturbances such as swirl is not performed on the pre-correction target resistance $R_0$, and only the correction for water temperature change is performed on the pre-correction target resistance $R_0$. After the predetermined period $T_1$ elapses, in addition to the correction for water temperature change, the correction for disturbances such as swirl is performed on the pre-correction target resistance $R_0$.

The intermediate value setting means 37 sets, on the basis of the difference $\Delta X$ calculated by the difference calculation means 36, an initial value of the intermediate target resistance $R_{MID}$ which is a target resistance used for resistance control of the glow plug 1 during the intermediate temperature raising. The initial value of the intermediate target resistance $R_{MID}$ is obtained by subtracting an offset value $R_{OFF}$ corresponding to the difference $\Delta X$ from the target resistance $R_{TAR}$.

The offset value $R_{OFF}$ is set in advance for each value of the difference $\Delta X$. In the present embodiment, the greater the difference $\Delta X$ (that is, the greater the deviation of the temperature of the glow plug 1 from the target temperature), the greater the offset value $R_{OFF}$. However, when the difference $\Delta X$ is greater than a previously set, predetermined maximum difference $X_{MAX}$ (e.g., 800 mΩ), the offset value $R_{OFF}$ is set to a predetermined maximum offset value $R_{OFFMAX}$ (e.g., 200 mΩ).

Notably, the maximum offset value $R_{OFFMAX}$ is determined as follows. That is, when the difference between the resistance R of the glow plug 1 and the target resistance $R_{TAR}$ becomes equal to or greater than a certain value, during PI control of the glow plug 1, the duty ratio is set to maximum (100%; notably, in some cases, the maximum duty ratio is limited to about 98% in order to prevent excessive temperature rising or the like). In other words, in the case where the resistance R of the glow plug 1 deviates from the target resistance $R_{TAR}$ by a certain value or greater, even when the duty ratio is set to the maximum, the glow plug 1 can be heated without causing overshoot (excessive temperature rising) of the glow plug 1.

In consideration of this point, in the present embodiment, among values of the difference which render the duty ratio a maximum, the smallest value (the above-mentioned certain value) is used as the maximum offset value $R_{OFFMAX}$. By setting the maximum offset value $R_{OFFMAX}$ in this manner, the electric power supplied to the glow plug 1 is restricted such that the glow plug 1 has no overshoot when the glow plug 1 is PI-controlled on the basis of the intermediate target resistance $R_{MID}$ obtained by subtracting the maximum offset value $R_{OFFMAX}$ from the target resistance $R_{TAR}$.

Meanwhile, since the maximum offset value $R_{OFFMAX}$ is equal to the minimum value of the difference, the minimum value ($R_{TAR}-R_{OFFMAX}$) of the intermediate target resistance $R_{MID}$ is relatively large. Therefore, in the initial stage of the intermediate temperature raising, in which the difference between the temperature of the glow plug 1 and the target temperature is relatively large, the temperature of the glow plug 1 can be raised quickly. Notably, the maximum offset value $R_{OFFMAX}$ can be set individually in accordance with the type of a glow plug to be controlled (e.g., a difference in materials which constitute the heating coil 9 and the control coil 10) and the type of the engine (e.g., a difference in cooling amount during operation of the engine).

The intermediate value update means 38 gradually increases the intermediate target resistance $R_{MID}$ with elapse of energization time to thereby update the intermediate target resistance $R_{MID}$. In the present embodiment, the intermediate value update means 38 is configured such that, as the difference between the intermediate target resistance $R_{MID}$ and the target resistance $R_{TAR}$ deceases, an increase in the intermediate target resistance $R_{MID}$ per unit time decreases stepwise.

Figure 4:
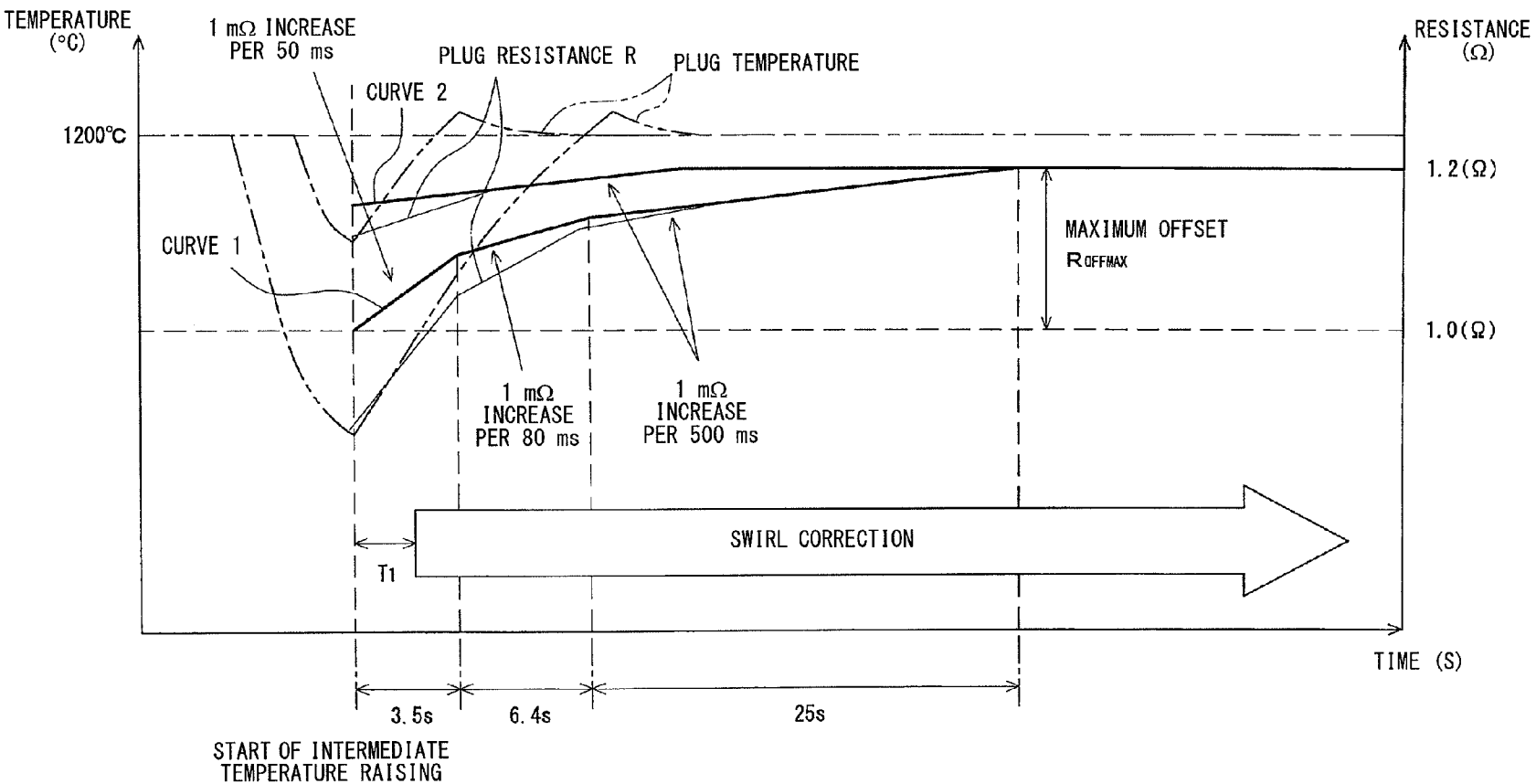
FIG. 4 is a graph showing changes in intermediate target resistance, resistance of a glow plug, etc., with elapse of energization time.

Specifically, as indicated by curves 1 and 2 of FIG. 4 (notably, in FIG. 4, the intermediate target resistance $R_{MID}$ is shown by a thick line), when the difference between the intermediate target resistance $R_{MID}$ and the target resistance $R_{TAR}$ (e.g., 1.2Ω) is equal to or greater than a previously set, predetermined first threshold $D_1$ (in the present embodiment, 0.13Ω), the intermediate target resistance $R_{MID}$ is increased at a rate of $\alpha_1$ (mΩ/s) per unit energization time (in the present embodiment, at a rate of 1 mΩ per 50 ms). When the difference between the intermediate target resistance $R_{MID}$ and the target resistance $R_{TAR}$ is between the first threshold $D_1$ and a predetermined second threshold $D_2$ (in the present embodiment, 0.05Ω), the intermediate target resistance $R_{MID}$ is increased at a rate of $\alpha_2$ (mΩ/s) per unit energization time (in the present embodiment, at a rate of 1 mΩper 80 ms). When the difference between the intermediate target resistance $R_{MID}$ and the target resistance $R_{TAR}$ is less than the second threshold $D_2$, the intermediate target resistance $R_{MID}$ is increased at a rate of $\alpha_3$ (mΩ/s) per unit energization time (in the present embodiment, at a rate of 1 mΩ per 500 ms). When the difference between the intermediate target resistance $R_{MID}$ and the target resistance R finally becomes very small (becomes equal to or less than a previously set, predetermined third threshold $D_3$), the intermediate target resistance $R_{MID}$ is set to a value equal to the target resistance $R_{TAR}$. Notably, the energization time $t_n$ from the start of the intermediate temperature raising is measured by an unillustrated timer. The curves 1 and 2 of FIG. 4 show variations in the intermediate target resistance $R_{MID}$, etc., for the case where the target resistance $R_{TAR}$ is maintained constant. The variations in the intermediate target resistance $R_{MID}$, etc., change in accordance with a change in the target resistance $R_{TAR}$. Notably, in the present embodiment, an update of the intermediate target resistance $R_{MID}$ is performed at constant intervals.

Figure 5:
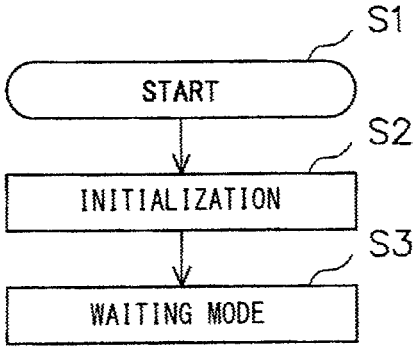
FIG. 5 is a flowchart showing a main routine of a GCU operation program.
Figure 6:
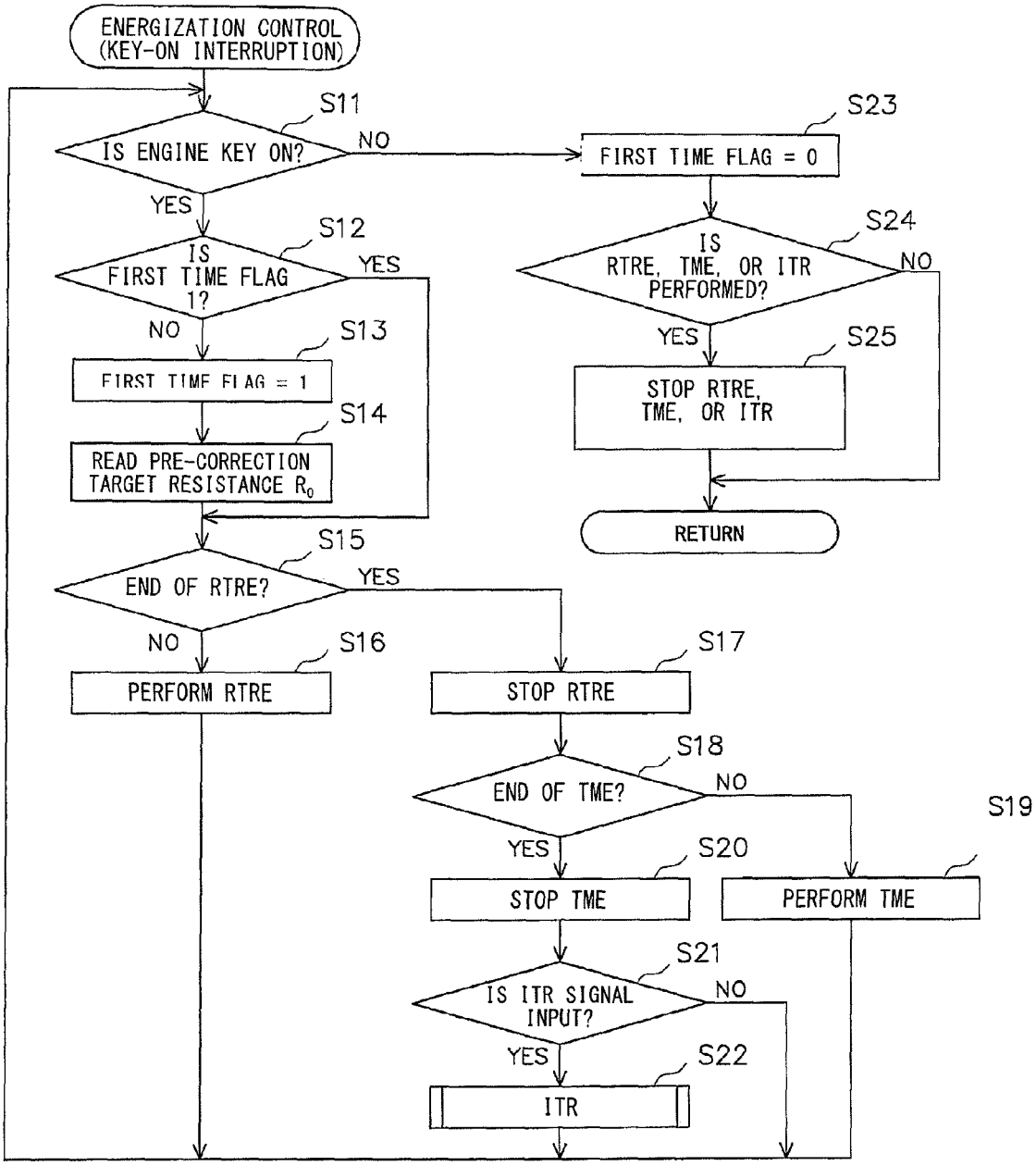
Figure 7:
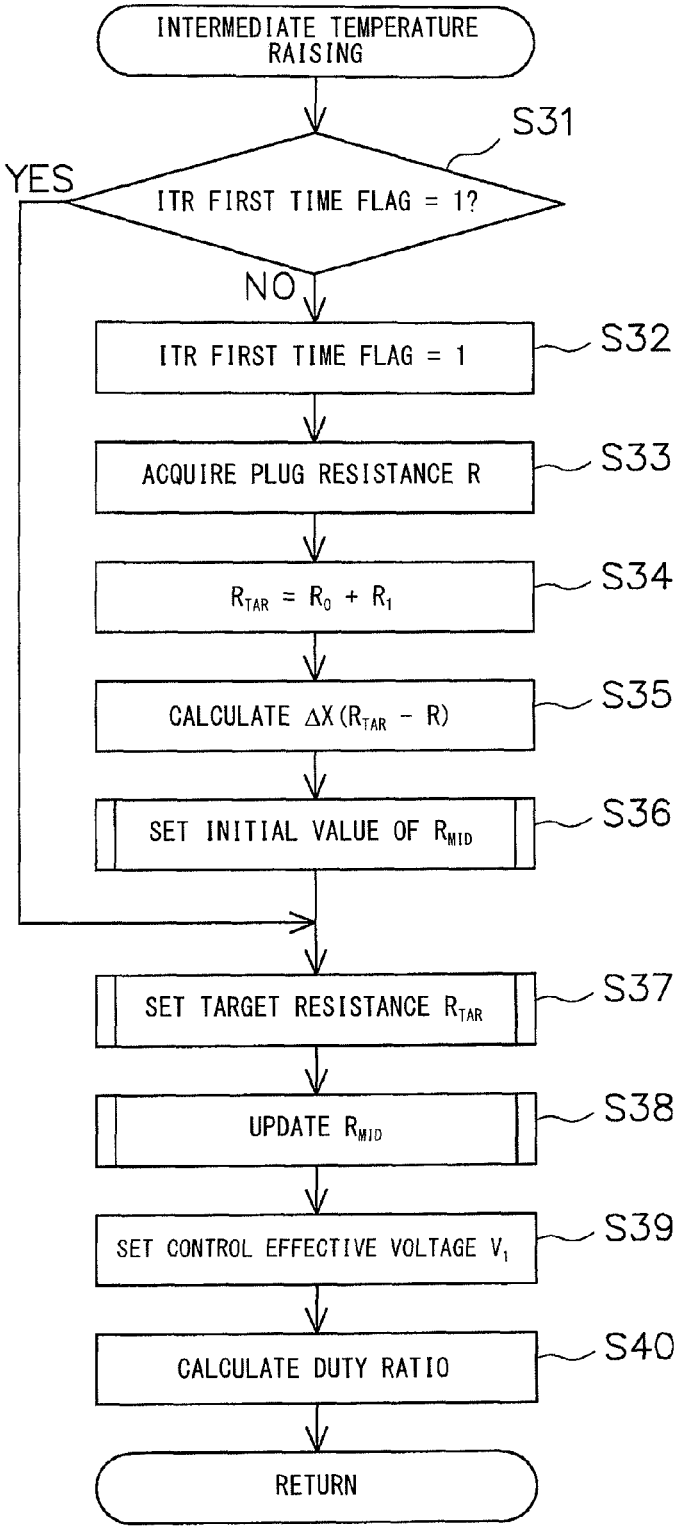
FIG. 7 is a flowchart showing processing performed during intermediate temperature raising.
Figure 8:
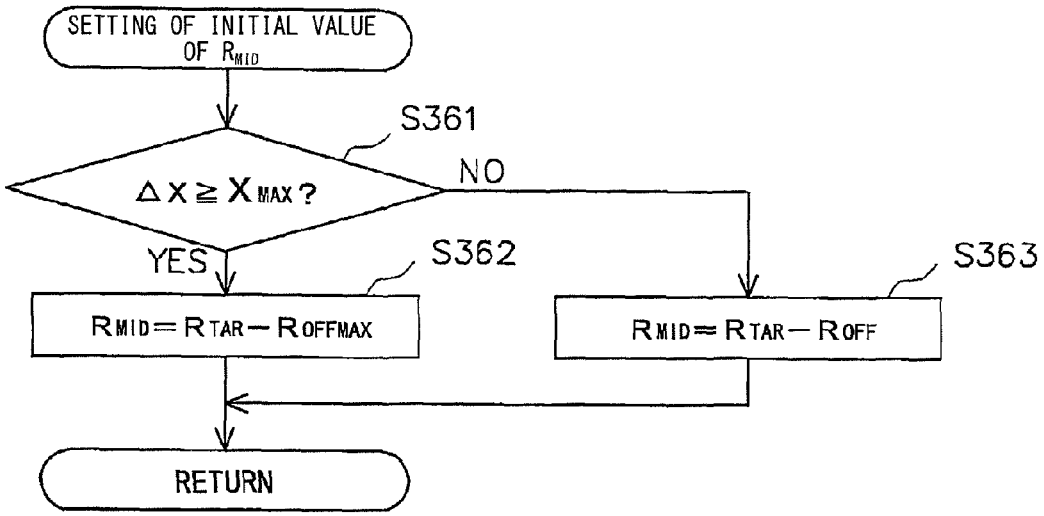
FIG. 8 is a flowchart showing processing for setting an initial value of an intermediate target resistance.
Figure 9:
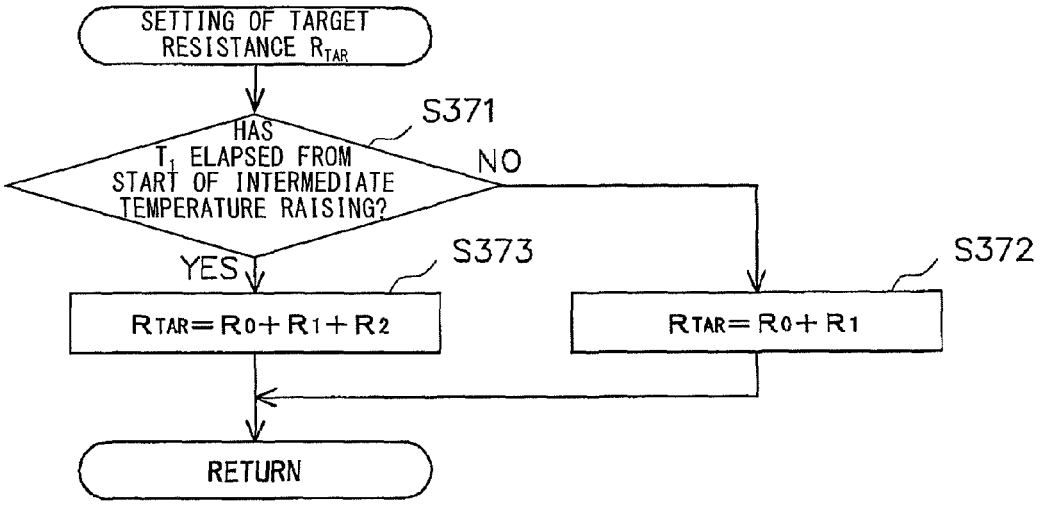
FIG. 9 is a flowchart showing processing for setting the target resistance.
Figure 10:
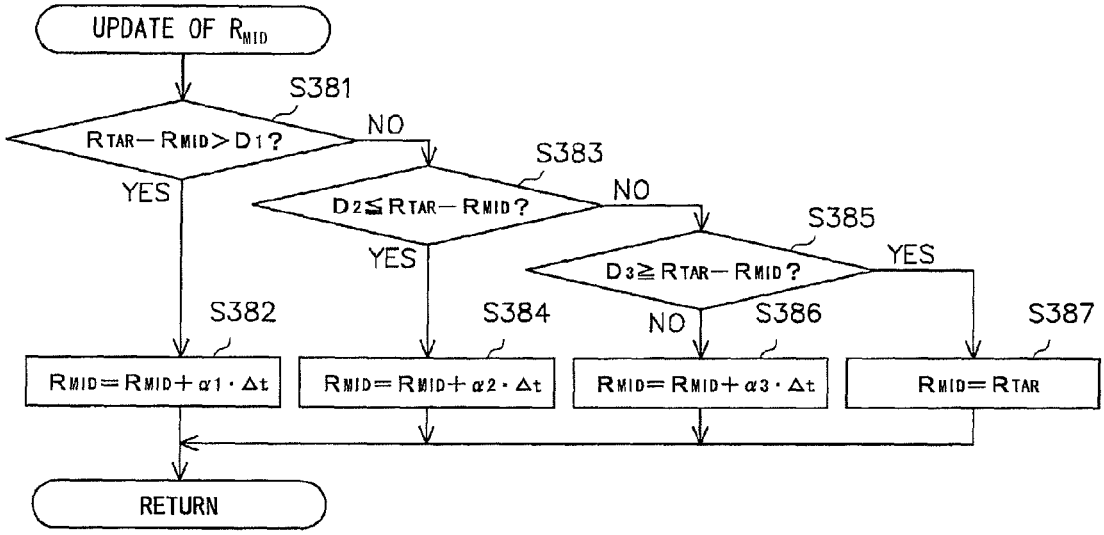
FIG. 10 is a flowchart showing processing for updating the intermediate target resistance.

Next, a specific example of energization control performed by the GCU 21 for the glow plug 1 will be described in accordance with the flowcharts of FIGS. 5 to 10. FIG. 5 is a flowchart showing a main routine of a GCU operation program. FIG. 6 is a flowchart showing energization control performed through interruption when the engine key EK is on. FIG. 7 is a flowchart showing processing performed during the intermediate temperature raising. FIG. 8 is a flowchart showing processing for setting the initial value of the intermediate target resistance $R_{MID}$. FIG. 9 is a flowchart showing processing for setting the target resistance $R_{TAR}$. FIG. 10 is a flowchart showing processing for updating the intermediate target resistance $R_{MID}$.

First, as shown in FIG. 5, the GCU 21 (the microcomputer 31) starts in S1 upon connection of the battery VA to the GCU 21 (for example, when the GCU 21 and the battery VA are connected together after assembly of the vehicle or when the battery VA is connected again after being removed at the time of exchange of the glow plug 1). In S2 subsequent thereto, the microcomputer 31 performs initialization processing, including resetting of RAM and resetting of the pre-correction target resistance $R_0$.

Next, in S3, the microcomputer 31 enters a waiting mode (power saving mode). In this waiting mode (S3), exchange of the glow plug 1 is detected. When the engine key EK is turned from on to off after detection of the exchange of the glow plug 1, calibration is performed, whereby the pre-correction target resistance $R_0$ of the glow plug 1 is obtained. Notably, in the present embodiment, it is assumed that calibration has already been performed, and the pre-correction target resistance $R_0$ has been obtained.

In the waiting mode (S3), the microcomputer 31 waits until an interruption signal is input to the microcomputer 31 as a result of the engine key EK being turned on.

When the engine key EK is turned on and an interruption signal is input to the microcomputer 31, the microcomputer 31 enters a normal mode, and, as shown in FIG. 6, the microcomputer 31 determines whether or not the engine key EK is on, from a voltage of a terminal of the microcomputer 31 connected to the engine key EK (S11). When the engine key EK is on, the microcomputer 31 proceeds to S12.

In S12, the microcomputer 31 checks a first time flag. This "first time flag" is used as a determination condition for executing specific initial setting processing (S13 and S14 described below) only when the engine key EK is turned from off to on. The initial setting processing is a portion of a series of processing steps of the energization control program executed repeatedly when the engine key EK is on. In the initial state, the first time flag is set to 0.

When the first time flag indicates that the condition is not satisfied (0) (S12; No), the microcomputer 31 sets the first time flag to 1 in S13 so that the microcomputer 31 can skip from S12 to S15 in the next and subsequent execution cycles. The microcomputer 31 then reads the pre-correction target resistance $R_0$ (reference to a value) (S14).

Next, the microcomputer 31 performs rapid temperature raising energization; i.e., energization for rapidly raising the temperature of the glow plug 1 (S16), from the start of energization of the glow plug 1, until the temperature of the glow plug 1 reaches a predetermined target temperature (S15; No).

After that, the microcomputer 31 returns to S11, and repeats the processing of S11 to S16, until the rapid temperature raising energization ends, to thereby continue the rapid temperature raising energization of the glow plug 1. Notably, since the first time flag has been set to 1 in S13, the microcomputer 31 proceeds from S12 to S15 without performing the processing of S13 and S14 in the next and subsequent execution cycles.

In the present embodiment, the microcomputer 31 determines in S15 that the rapid temperature raising energization must be ended, when one of the following three conditions is satisfied. The first condition is such that a predetermined period (e.g., 3.3 sec) has elapsed after the start of the rapid temperature raising energization. The second condition is such that the cumulative electric energy supplied to the glow plug 1 has reached a predetermined electric energy (e.g., about 214 J). In these cases, since the temperature of the glow plug 1 is considered to have reached the target temperature, the rapid temperature raising energization is ended. The third condition is such that the resistance R of the glow plug 1 measured by the microcomputer 31 has reached a predetermined resistance. That is, in the case where the temperature of the glow plug 1 is already somewhat high at the time when the supply of electric power to the glow plug 1 is started (e.g., the case where re-energization is performed before the glow plug has not yet been cooled sufficiently after the previous energization has ended), the supply of electric power is stopped when the resistance R of the glow plug 1 reaches the predetermined resistance. This operation can prevent excessive temperature rising of the glow plug 1.

When one of the above-mentioned end conditions is satisfied, while the rapid temperature raising energization is continued through repetition of steps S11 to S16, and the microcomputer 31 determines that the rapid temperature raising energization has ended (S15; Yes), the microcomputer 31 stops the rapid temperature raising energization of the glow plug 1 (S17). In the present embodiment, after the rapid temperature raising energization, temperature maintaining energization (so-called after glow) is performed.

In the temperature maintaining energization, as described above, the duty ratio is calculated on the basis of the control effective voltage $V_1$ obtained from the target resistance $R_{TAR}$ and the voltage output from the GCU 21 to the glow plug 1 (controller output voltage); and the supply of electric current to the glow plug 1 is controlled in accordance with the duty ratio. After that, the microcomputer 31 continues the temperature maintaining energization (S19) until a condition for ending the temperature maintaining energization is satisfied (that is, the result of determination in S18 becomes "Yes").

When the microcomputer 31 determines that the temperature maintaining energization has ended after the continuation of the temperature maintaining energization (S18; Yes), the microcomputer 31 stops the supply of electric power to the glow plug 1 (S20). Notably, the condition for ending the temperature maintaining energization may be passage of a predetermined time (e.g., 180 sec) after the start of the temperature maintaining energization.

When an intermediate temperature raising signal is input after the end of the temperature maintaining energization (after glow energization) (S21; Yes), the microcomputer 31 performs intermediate temperature raising (S22) in order to cause the glow plug 1 to generate heat again. The intermediate temperature raising will be described in detail below.

When the engine key EK is turned off, whereby operation of the engine EN is stopped (S11; No), the microcomputer 31 resets the first time flag (S23) so as to perform the processing of S13, etc., when the engine EN is operated the next time. If the rapid temperature raising energization, the temperature maintaining energization, or the intermediate temperature raising for the glow plug 1 is being performed when the engine key EK is turned off (S24; Yes), the microcomputer 31 stops the supply of electric current to the glow plug 1 (S25), and enters the waiting mode (power saving mode).

Next, energization control for the intermediate temperature raising will be described.

As shown in FIG. 7, in the intermediate temperature raising, the microcomputer 31 first checks an intermediate temperature raising (ITR) first time flag in S31. This "ITR first time flag" is used as a determination condition for executing the processing of setting the initial value of the intermediate target resistance $R_{MID}$ only when the intermediate temperature raising is performed first time. In the initial state, the ITR first time flag is set to 0.

When the ITR first time flag indicates that the condition is unsatisfied (0) (S31; No), the microcomputer 31 sets the ITR first time flag to 1 in S32 so that the microcomputer 31 can skip from S31 to S37 in the next and subsequent execution cycles. The microcomputer 31 then acquires the resistance R of the glow plug 1 (S33), and sets the target resistance $R_{TAR}$ (S34). At this time, since the predetermined period $T_1$ is considered not to have elapsed after the start of the intermediate temperature raising, a resistance obtained by adding the correction value $R_1$ for water temperature change to the pre-correction target resistance $R_0$ is set as the target resistance $R_{TAR}$.

After that, the microcomputer 31 calculates the difference ΔX between the resistance R of the glow plug 1 and the set target resistance $R_{TAR}$ (S35). In S36, the microcomputer 31 sets the initial value of the intermediate target resistance $R_{MID}$ on the basis of the obtained difference ΔX.

That is, as shown in FIG. 8, when the difference ΔX is equal to or greater than the above-mentioned maximum difference $X_{MAX}$ (S361; Yes), the microcomputer 31 sets (stores), as the initial value of the intermediate target resistance $R_{MID}$, a value obtained by subtracting the maximum offset value $R_{OFFMAX}$ from the target resistance $R_{TAR}$ (S362). Meanwhile, when the difference ΔX is less than the maximum difference $X_{MAX}$ (S361; No), the microcomputer 31 sets, as the initial value of the intermediate target resistance $R_{MID}$, a value obtained by subtracting an offset value $R_{OFF}$ corresponding to the difference ΔX from the target resistance $R_{TAR}$ (S363).

Next, in S37, the microcomputer 31 sets the target resistance $R_{TAR}$ in accordance with the time elapsed after the start of the intermediate temperature raising. That is, as shown in FIG. 9, before the previously set, predetermined period $T_1$ elapses after the start of the intermediate temperature raising (S371; No), the microcomputer 31 sets (stores), as the target resistance $R_{TAR}$, a value obtained by adding the correction value $R_1$ for water temperature change to the pre-correction target resistance $R_0$ (S372). Meanwhile, when the previously set, predetermined period $T_1$ has elapsed after the start of the intermediate temperature raising (S371; Yes), the microcomputer 31 sets, as the target resistance $R_{TAR}$, a value obtained by adding the correction value $R_1$ for water temperature change and the correction value $R_2$ for swirl to the pre-correction target resistance $R_0$ (S373).

Next, in S38, the microcomputer 31 gradually increases the intermediate target resistance $R_{MID}$ with elapse of energization time, to thereby update the intermediate target resistance $R_{MID}$. That is, as shown in FIG. 10, when the difference between the set target resistance $R_{TAR}$ and the intermediate target resistance $R_{MID}$ is greater than the first threshold $D_1$ (S381; Yes), the microcomputer 31 updates the intermediate target resistance $R_{MID}$ to a value which is increased from the intermediate target resistance $R_{MID}$ by a value obtained by multiplying the above-mentioned $\alpha_1$ (mΩ/s) by the difference (Δt) between the energization time $t_n$ measured at the time of the present update and the energization time $t_{n-1}$ measured at the time of the previous update (S382).

When the difference between the target resistance $R_{TAR}$ and the intermediate target resistance $R_{MID}$ is not greater than the first threshold $D_1$ (S381; No), the microcomputer 31 checks whether or not the difference between the target resistance $R_{TAR}$ and the intermediate target resistance $R_{MID}$ is equal to or greater than the second threshold $D_2$ (S383). When the difference is equal to or greater than the second threshold $D_2$ (S383; Yes), the microcomputer 31 updates the intermediate target resistance $R_{MID}$ to a value which is increased from the intermediate target resistance $R_{MID}$ by a value obtained by multiplying the above-mentioned $\alpha_2$ (mΩ/s) by Δt (S384).

When the difference between the target resistance $R_{TAR}$ and the intermediate target resistance $R_{MID}$ is less than the second threshold $D_2$ (S383; No), the microcomputer 31 checks whether or not the difference is equal to or less than the third threshold $D_3$ (S385). When the difference is greater than the third threshold $D_3$ (S385; No), the microcomputer 31 updates the intermediate target resistance $R_{MID}$ to a value which is increased from the intermediate target resistance $R_{MID}$ by a value obtained by multiplying the above-mentioned $\alpha_3$ (mQ/s) by $\Delta t$ (S386).

Meanwhile, when the difference between the target resistance $R_{TAR}$ and the intermediate target resistance $R_{MID}$ is equal to or less than the third threshold $D_3$ (S385; Yes), the microcomputer 31 sets the intermediate target resistance $R_{MID}$ to a value equal to the target resistance $R_{TAR}$ (S387).

After update of the intermediate target resistance $R_{MID}$ in S38, in S39, the microcomputer 31 sets, on the basis of the intermediate target resistance $R_{MID}$ and the resistance R of the glow plug 1, the control effective voltage $V_1$ to be applied to the glow plug 1. Subsequently, the microcomputer 31 calculates the duty ratio on the basis of the control effective voltage $V_1$ and the voltage output from the GCU 21 to the glow plug 1 (controller output voltage) (S40), and controls the supply of electricity to the glow plug 1 in accordance with the duty ratio. After that, the microcomputer 31 performs the intermediate temperature raising until the input of the intermediate energization signal stops (the result of the determination in S21 becomes "No"), or the engine key EK is turned off (the result of the determination in S11 becomes "No").

As having been described in detail, according to the present embodiment, during the intermediate temperature raising, energization control of the glow plug 1 is performed in accordance with a resistance control scheme. Therefore, the temperature of the glow plug 1 can be raised relatively rapidly, without causing problems, such as an increase in processing load, which would otherwise occur in the case where the energization control is performed on the basis of the voltage applied to the glow plug 1.

Figure 11:
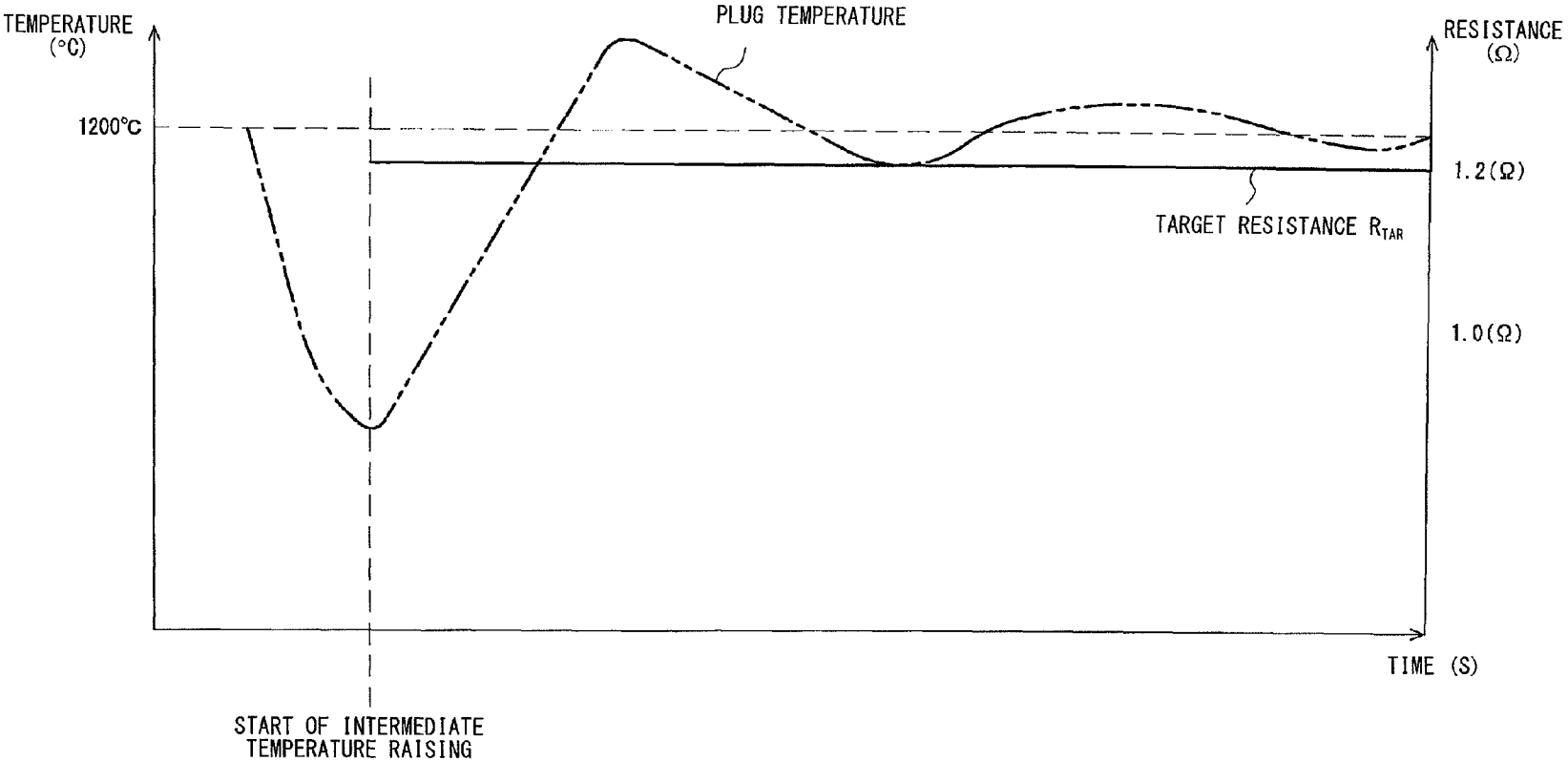
FIG. 11 is a graph showing a change in temperature of a glow plug when intermediate temperature raising is performed in accordance with a conventional method.

As shown in FIG. 11, in the case where energization control is performed such that the resistance of the glow plug 1 coincides with the target resistance $R_{TAR}$ from the beginning of the intermediate temperature raising, after the temperature of the glow plug 1 increases excessively, the temperature of the glow plug 1 starts to decrease, whereby the glow plug 1 requires a relative long period before it is able to stably generate heat at the target temperature. In contrast, in the present embodiment, a value obtained by subtracting from the target resistance $R_{TAR}$ an offset value $R_{OFF}$ corresponding to the difference $\Delta X$ between the resistance R of the glow plug 1 and the target resistance $R_{TAR}$ is set as the intermediate target resistance $R_{MID}$. The energization of the glow plug 1 is then controlled such that the resistance R of the glow plug 1 coincides with the intermediate target resistance $R_{MID}$, which is gradually increased with elapse of the energization time such that it finally coincides with the target resistance $R_{TAR}$. That is, in a stage in which excessive temperature rising of the glow plug 1 may occur, the energization control of the glow plug 1 is performed, while a resistance lower than the original target resistance $R_{TAR}$ is used as an intermediate target resistance $R_{MID}$. Thus, the temperature of the glow plug 1 is raised rapidly, while the occurrence of excessive temperature rising (overshoot) is prevented more reliably. In a state in which a temperature drop of the glow plug 1 may occur, by means of gradually increasing the intermediate target resistance $R_{MID}$, the glow plug 1 is caused to finally reach the target temperature, without causing a temperature drop of the glow plug 1. By means of performing energization control on the basis of the intermediate target resistance $R_{MID}$ lower than the target resistance $R_{TAR}$, and by gradually increasing the intermediate target resistance $R_{MID}$, it becomes possible to prevent overshoot of the glow plug 1 more reliably, and to effectively suppress a temperature variation of the glow plug 1 around the target temperature. As a result, the glow plug 1 can be caused, within a short period of time, to more stably generate heat at the target temperature.

Further, since the temperature variation of the glow plug 1 around the target temperature can be suppressed, in the present embodiment, the target temperature of the glow plug 1 can be set to a higher temperature (e.g., 1200° C. or higher). As a result, further reduction of emissions becomes possible.

Moreover, the offset value $R_{OFF}$ is set such that the greater the difference $\Delta X$ between the resistance R of the glow plug 1 and the target resistance $R_{TAR}$, the greater the offset value $R_{OFF}$. That is, in the case where the temperature drop of the glow plug 1 in relation to the target temperature is large and overshoot of the glow plug 1 is more likely to occur, a sufficiently small value is set as the intermediate target resistance $R_{MID}$. Therefore, overshoot of the glow plug 1 can be prevented more reliably.

Meanwhile, in the case where the difference $\Delta X$ between the resistance R of the glow plug 1 and the target resistance $R_{TAR}$ is equal to or greater than the predetermined maximum difference $X_{MAX}$, the offset value $R_{OFF}$ is set to the predetermined maximum offset value $R_{OFFMAX}$. That is, in the case where the difference between the temperature of the glow plug 1 and the target temperature is sufficiently large and overshoot of the glow plug 1 is unlikely to occur even when a relatively large voltage is applied thereto, the intermediate target resistance $R_{TAR}$ is not decreased excessively, and a constant value is set as the intermediate target resistance $R_{TAR}$. Therefore, the temperature of the glow plug 1 can be raised more rapidly, and the time required for the temperature raising can be shortened further.

Further, as the difference between the intermediate target resistance $R_{MID}$ and the target resistance $R_{TAR}$ decreases; i.e., as the temperature of the glow plug 1 approaches the target temperature, the increase amount per unit time of the intermediate target resistance $R_{MID}$ is reduced. Accordingly, it is possible to cause the glow plug 1 to generate heat at the target temperature even more stably, after having reached the target temperature, while suppressing excessive temperature rising of the glow plug 1.

Moreover, the target resistance $R_{TAR}$ is updated on the basis of environmental information representing change in water temperature or the like, and information representing changes in disturbances which cause a temperature change of the glow plug 1. Accordingly, the target resistance $R_{TAR}$ can be set more properly, and the glow plug 1 can be caused to reach the target temperature more reliably and more accurately. Furthermore, the temperature of the glow plug 1 can be maintained at the target temperature with even greater stability.

Meanwhile, in the intermediate temperature raising, the target resistance $R_{TAR}$ is fixed until the above-mentioned predetermined period $T_1$ has elapsed after the re-start (resumption) of energization of the glow plug 1, excepting that the target resistance $R_{TAR}$ is changed depending on the information representing the environmental temperature. That is, during the above-mentioned predetermined period $T_1$, correction of the target resistance $R_{TAR}$ for disturbances is not performed. Accordingly, in the initial stage of the intermediate temperature raising (when the resistance R of the glow plug 1 is relatively low), the target resistance $R_{TAR}$ (accordingly, the intermediate target resistance $R_{MID}$) can be decreased to some extent, whereby overshoot of the glow plug 1 can be prevented with even greater reliability.

Notably, the present invention is not limited to the above-described embodiment, and may be practiced as follows. Needless to say, other application examples and modifications not illustrated below are also possible.

(a) In the above-described embodiment, the intermediate target resistance $R_{MID}$ is increased stepwise. However, the intermediate target resistance $R_{MID}$ may be increased continuously (changed gradually with energization time). In the above-described embodiment, update of the intermediate target resistance $R_{MID}$ is performed at constant intervals. The timing of update may be changed in accordance with energization time or the current resistance R of the glow plug 1.

(b) In the above-described embodiment, the GCU 21 sets the target resistance $R_{TAR}$ (accordingly, the intermediate target resistance $R_{MID}$) on the basis of water temperature information and information representing changes in disturbances which cause a temperature change of the glow plug 1. However, the intermediate target resistance $R_{MID}$ may be set without use of information representing the environmental temperature and information representing changes in disturbances. In this case, the processing load can be reduced. In addition, since communication means or the like through which the microcomputer 31 receives information from the water temperature sensor SE, etc., is not required, production cost can be lowered.

(c) In the above-described embodiment, the GCU 21 is configured to control energization of the glow plug 1 (metal glow plug) having the heating coil 9. The object controlled by the GCU 21 is not limited thereto. For example, the sizes of various members, the composition of the coil, etc., can be freely changed so that the glow plug 1 can be readily controlled by the GCU 21. Furthermore, the glow plug is not limited to a metal glow plug. Accordingly, for example, the GCU 21 may be configured to control the energization of a ceramic glow plug having a ceramic heater.

(d) In the above-described embodiment, the water temperature sensor SE is shown as environmental temperature acquisition means. However, the environmental temperature acquisition means is not limited to the water temperature sensor SE. Accordingly, the above-described embodiment may be modified such that, for example, a sensor for measuring intake air temperature, an oil temperature sensor, and the like are provided as the environmental temperature acquisition means, and the target resistance $R_{TAR}$ is set on the basis of information obtained from these sensors.

(e) In the above-described embodiment, the GCU 21 and the ECU 42 are provided separately. However, the ECU 42 may be configured to provide the function of the GCU 21, and perform energization control of the glow plug 1 by the function of the GCU provided by the ECU 42.

(f) In the above-described embodiment, when the initial value of the intermediate target resistance $R_{MID}$ is set (S36), if the difference $\Delta X$ between the target resistance $R_{TAR}$ and the resistance R of the glow plug 1 is equal to or greater than the maximum difference $X_{MAX}$, a value obtained by subtracting the maximum offset value $R_{OFFMAX}$ from the target resistance $R_{TAR}$ is set as the initial value of the intermediate target resistance $R_{MID}$. However, the embodiment may be modified such that, for example, without comparing the difference $\Delta X$ and the maximum difference $X_{MAX}$, the initial value of the intermediate target resistance $R_{MID}$ is determined by subtracting the offset value $R_{OFF}$ corresponding to the difference $\Delta X$ from the target resistance $R_{TAR}$.

(g) In the above-described embodiment, when the target resistance $R_{TAR}$ is set in S37, a determination as to whether or not the correction value $R_2$ for swirl is to be added is made on the basis of the time elapsed after the start of the intermediate temperature raising. However, the target resistance $R_{TAR}$ may be set without making such a determination. For example, the correction value $R_2$ for swirl may be added to the target resistance $R_{TAR}$ irrespective of the time elapsed after the start of the intermediate temperature raising.

(h) In the above-described embodiment, when the intermediate target resistance $R_{MID}$ is updated (S38), as the difference between the intermediate target resistance $R_{MID}$ and the target resistance $R_{TAR}$ decreases, the amount by which the intermediate target resistance $R_{MID}$ is increased per unit time decreases. However, the method of updating the intermediate target resistance $R_{MID}$ is not limited thereto. For example, the intermediate target resistance $R_{MID}$ may be increased at a constant rate without changing the increase amount per unit time.

It should further be apparent to those skilled in the art that various changes in form and detail of the invention as shown and described above may be made. It is intended that such changes be included within the spirit and scope of the claims appended hereto.

This application claims priority from Japanese Patent Application No. 2010-133772 filed Jun. 11, 2010, the disclosure of which is incorporated herein by reference in its entirety.

What is claimed is:

1. An energization control apparatus for a glow plug which generates heat upon supply of electric current thereto and having a resistance which changes in accordance with its own temperature, the energization control apparatus controlling a voltage applied to the glow plug in accordance with a resistance control scheme so that the resistance of the glow plug coincides with a predetermined target resistance, the apparatus comprising:

temperature maintaining energization means for energizing the glow plug for heat generation during operation of an internal combustion engine to which the glow plug is attached; and intermediate temperature raising means for resuming energization of the glow plug during operation of the internal combustion engine, after energization by the temperature maintaining energization means, wherein the intermediate temperature raising means includes:

resistance acquisition means for acquiring the resistance of the glow plug;

difference calculation means for calculating a difference between the resistance of the glow plug acquired by the resistance acquisition means and the target resistance;

intermediate value setting means for setting an intermediate target resistance by subtracting an offset value corresponding to the difference between the resistance of the glow plug and from the target resistance; and intermediate value update means for increasing the intermediate target resistance with elapse of time for energization of the glow plug such that the intermediate target resistance finally coincides with the target resistance, wherein the voltage applied to the glow plug is controlled such that the resistance of the glow plug coincides with the intermediate target resistance.

2. The energization control apparatus for a glow plug according to claim 1, wherein the greater the difference between the resistance of the glow plug and the target resistance, the greater the value to which the offset value is set.

3. The energization control apparatus for a glow plug according to claim 1, wherein, when the difference between the resistance of the glow plug and the target resistance is equal to or greater than a previously set maximum difference, the offset value is set to a predetermined maximum offset value.

4. The energization control apparatus for a glow plug according to claim 1, wherein, as the difference between the intermediate target resistance and the target resistance decreases, the amount by which the intermediate target resistance is increased per unit time by the intermediate value update means is decreased.

5. The energization control apparatus for a glow plug according to claim 1, wherein the target resistance is updated on the basis of information representing a change in a disturbance which causes a temperature change of the glow plug.

6. The energization control apparatus for a glow plug according to claim 1, further comprising environmental temperature acquisition means for acquiring information representing a temperature of an environment in which the glow plug is used, wherein the target resistance is set in consideration of information representing the environmental temperature; and the target resistance is fixed until a previously set, predetermined period elapses after resumption of energization of the glow plug, excepting that the target resistance is changed depending on the information representing the environmental temperature.

* * * * *